US007350742B1

(12) United States Patent
Mariano et al.

(10) Patent No.: US 7,350,742 B1
(45) Date of Patent: Apr. 1, 2008

(54) PULLTHRU PAPER TOWEL DISPENSER

(75) Inventors: Dino Anthony Mariano, Pittsburgh, PA (US); Lisa Marlene Carvajal, Pittsburgh, PA (US); Eric Richard Colburn, Wexford, PA (US)

(73) Assignee: Helen of Troy Limited, St. Michael (BB)

( * ) Notice: Subject to any disclaimer, the term of this patent is extended or adjusted under 35 U.S.C. 154(b) by 301 days.

(21) Appl. No.: 10/908,486

(22) Filed: May 13, 2005

(51) Int. Cl.
*B65H 16/06* (2006.01)

(52) U.S. Cl. ..... 242/598.3; 242/598.5; 242/599.4

(58) Field of Classification Search ..... 242/598.3, 242/598.4, 598.5, 590, 596.8, 597.8, 599.4; 225/39, 46
See application file for complete search history.

(56) References Cited

U.S. PATENT DOCUMENTS

| | | | | |
|---|---|---|---|---|
| 1,582,645 | A | 4/1926 | Findley | |
| 1,952,349 | A | 4/1934 | Jarvis | |
| 2,256,342 | A | 9/1941 | Hope | |
| 3,304,034 | A * | 2/1967 | Jones | 242/598.4 |
| 3,494,518 | A | 2/1970 | Goss | |
| D216,740 | S | 3/1970 | Bye | |
| 3,918,661 | A | 11/1975 | Kichi et al. | |
| 4,222,532 | A | 9/1980 | DeLuca | |
| 4,354,643 | A | 10/1982 | Kenner | |
| 4,454,974 | A | 6/1984 | Cooke | |
| 4,720,053 | A | 1/1988 | Vance | |
| 4,771,966 | A | 9/1988 | Anderson | |
| 4,846,415 | A | 7/1989 | Jernberg et al. | |
| 5,318,210 | A | 6/1994 | Morand | |
| D363,214 | S | 10/1995 | Parola et al. | |
| 5,549,218 | A | 8/1996 | Asmussen | |
| 5,651,487 | A | 7/1997 | Hansen | |
| 5,727,721 | A * | 3/1998 | Guido et al. | 225/106 |
| 5,765,775 | A | 6/1998 | Keserica | |
| 5,842,655 | A | 12/1998 | McCarthy | |
| 6,241,180 | B1 * | 6/2001 | Potter | 242/571.5 |
| 6,267,322 | B1 | 7/2001 | Harmathy | |
| 6,302,348 | B1 | 10/2001 | Lillelund et al. | |
| D453,644 | S | 2/2002 | Baggett | |
| 6,644,563 | B2 | 11/2003 | Presson | |
| 6,726,145 | B1 | 4/2004 | Kraus | |
| 2002/0130211 | A1 | 9/2002 | Kerr | |

* cited by examiner

*Primary Examiner*—John Q. Nguyen
(74) *Attorney, Agent, or Firm*—Seyfarth Shaw LLP

(57) ABSTRACT

A device for dispensing paper towel sheets from a web of sheets arranged in a roll and separated by rows of perforations, the device comprising a base member adapted to support a roll of sheets for rotation about an axis, a first guide bar fixedly carried by the base and extending substantially parallel to the axis and spaced from the axis a distance greater than a maximum radius of the roll of sheets, and a second guide bar extending substantially parallel to the axis and carried by the base for movement, relative to the first guide bar, between a loading position facilitating loading of the roll onto the base and a dispensing position spaced from the first guide bar by a narrow gap through which a leading end of the roll may be freely received.

20 Claims, 7 Drawing Sheets

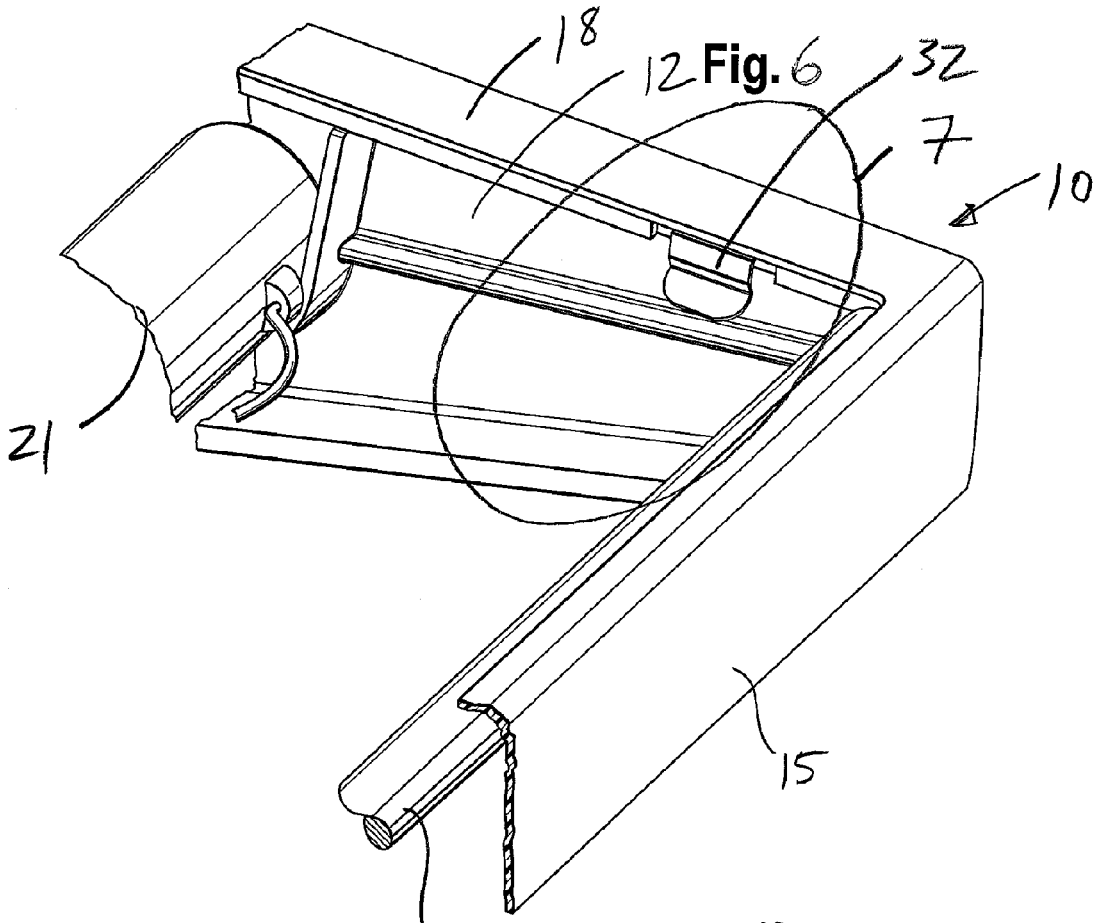
Fig. 6
Fig. 7
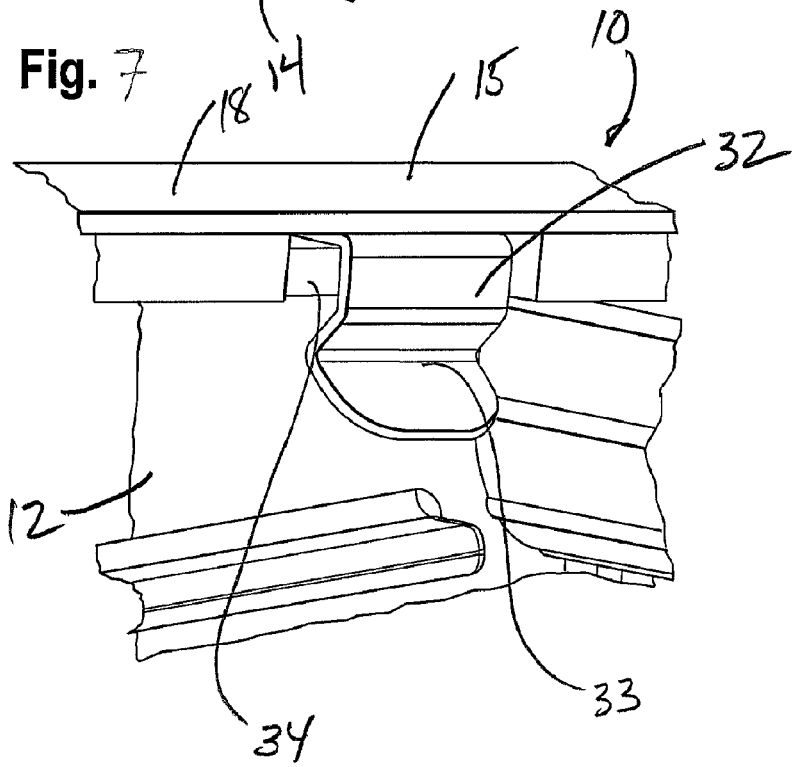

PULLTHRU PAPER TOWEL DISPENSER

BACKGROUND OF THE INVENTION

The present invention relates generally to paper towel holders, and more particularly to a paper towel holder that is adapted to be secured to a surface and which facilitates removal of one or more sheets of paper towels from a roll of paper towels with a pulling motion.

It is well-known that paper towel rolls have a cylindrical tube disposed substantially through the center thereof and a web of paper towel sheets arranged in a roll and separated by rows of perforations to facilitate tearing of the sheets. Such paper towel rolls have a maximum diameter determined, in part, to the number of paper towel sheets in the web. Prior paper towel roll holders may support the roll on its end with its rotational axis vertical, while other holders may support the roll with its axis horizontal, such as on a vertical wall or underneath a cabinet. Such devices, however, lack a means for controlling the number of sheets which are removed from the roll, and typically require two-handed operation—one to pull the sheets of paper towels outward, and the other to lock the roll in place, once the desired number of sheets has been attained, in order to tear the paper towels along the perforation.

Other prior art paper towel holders, such as those commonly found in public restrooms, comprise bulky housings that house a roll of papers towels, a lever to dispense paper towels and a serrated edge for tearing the papers towels. However, such paper towel holders are very bulky and are complicated to remove and reinstall a roll of paper towels.

SUMMARY OF THE INVENTION

The present application discloses a device for dispensing paper towel sheets from a web of sheets arranged in a roll and separated by rows of perforations. In an embodiment, the device includes a base member adapted to support a roll of sheets for rotation about an axis, a first guide bar fixedly carried by the base and extending parallel to the axis and spaced from the axis a distance greater than a maximum radius of the roll of sheets, and a second guide bar extending substantially parallel to the axis and carried by the base for movement between a loading position facilitating loading of the roll onto the base and a dispensing position spaced from the first guide bar by a narrow gap through which a leading end of the roll may be freely received.

It will be appreciated that by applying a generally pulling force to the leading end of the roll, a user may dispense a desired amount of paper towel sheets due to the rotation of the roll about its axis. When the desired number of sheets has been obtained, and when the perforation is adjacent to the second guide bar, the user can apply a generally outwardly directed force, thus causing the second guide bar to tear the sheet along the perforation.

BRIEF DESCRIPTION OF THE DRAWINGS

For the purpose of facilitating an understanding of the subject matter sought to be protected, there is illustrated in the accompanying figure an embodiment thereof, from an inspection of which, when considered in connection with the following description, the subject matter sought to be protected, its construction and operation, and many of its advantages, should be readily understood and appreciated.

FIG. 6 is an enlarged, fragmentary view of the circled portion shown in FIG. 5, with the paper towel roll removed for clarity.

FIG. 7 is an enlarged, fragmentary view of the circled portion shown in FIG. 6.

DETAILED DESCRIPTION

Figure 1:
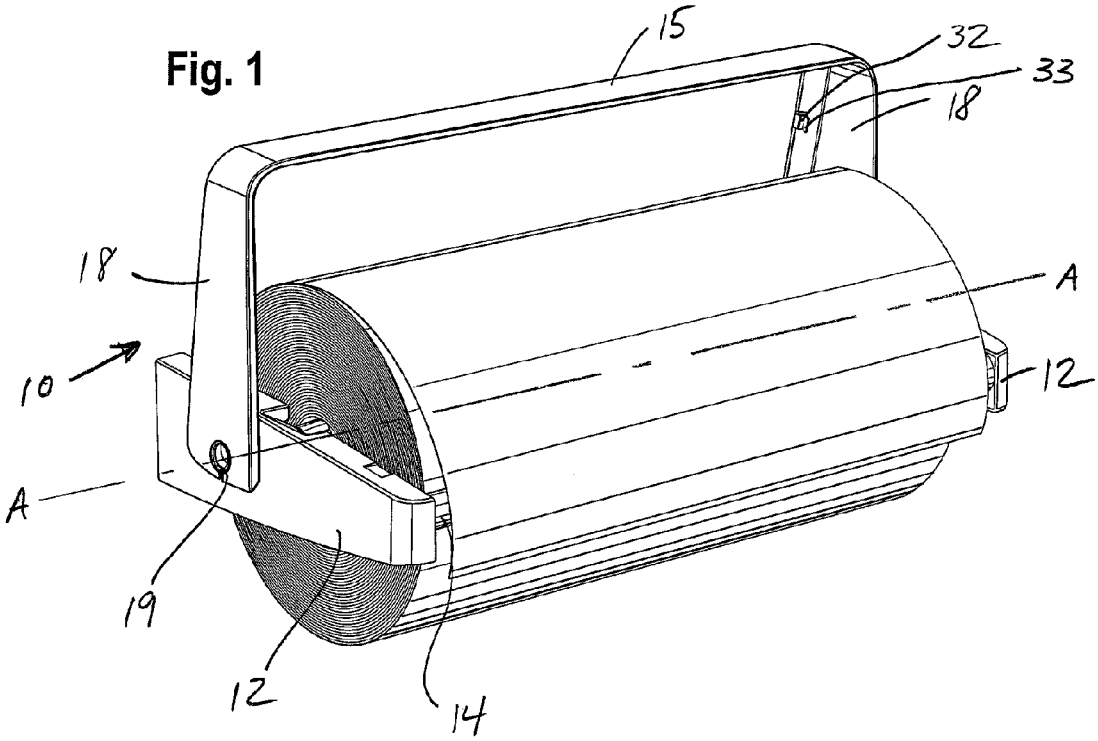
FIG. 1 is a perspective view of the dispenser of the present application with a roll of paper towels inserted therein and the second guide bar disposed in the loading position.
Figure 2:
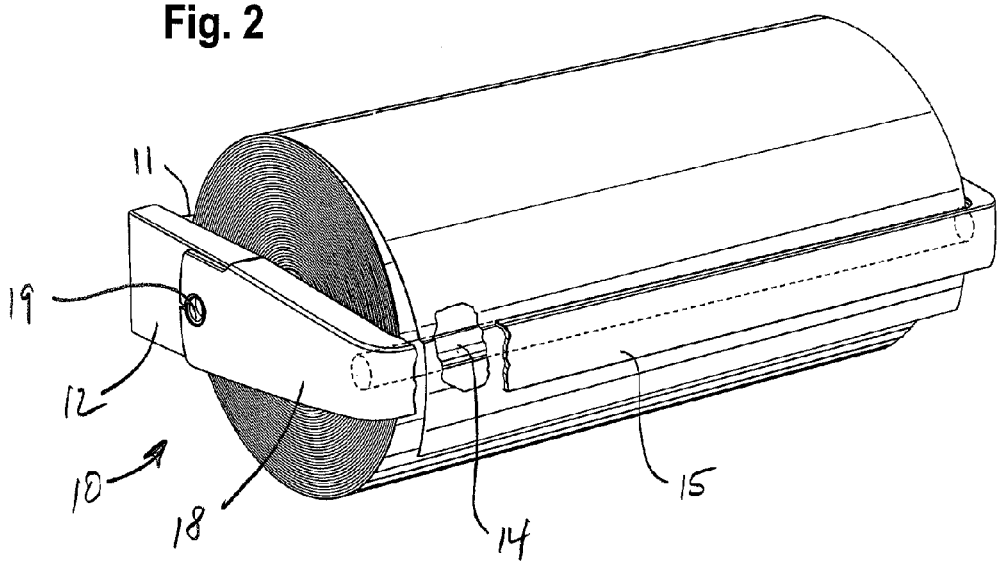
FIG. 2 is a view similar to FIG. 1, but with the second guide bar disposed in the dispensing position.
Figure 3:
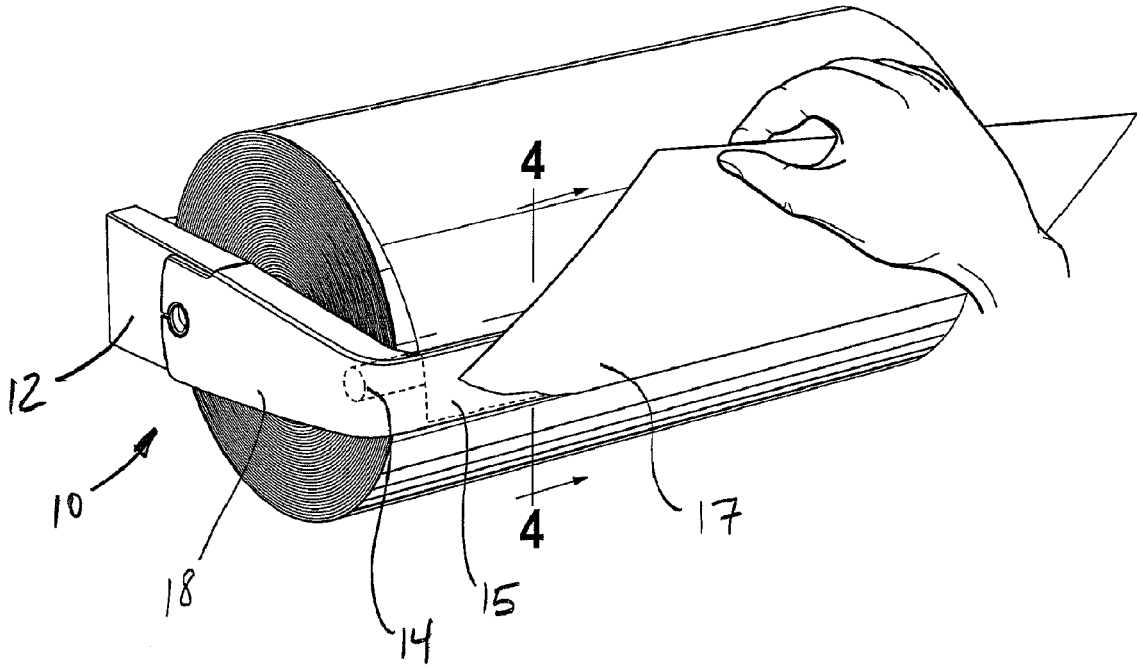
FIG. 3 is a view similar to FIG. 2 showing a sheet of paper towel being torn along the perforation.
Figure 4:
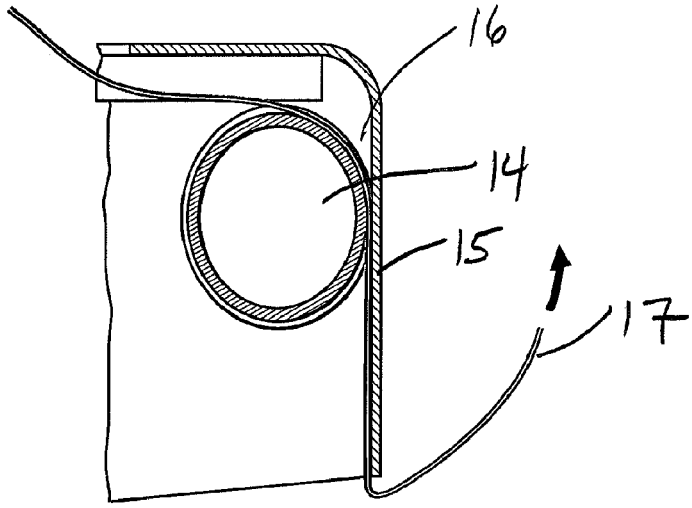
FIG. 4 is an enlarged, cross-sectional view taken along line 4-4 in FIG. 3.
Figure 5:
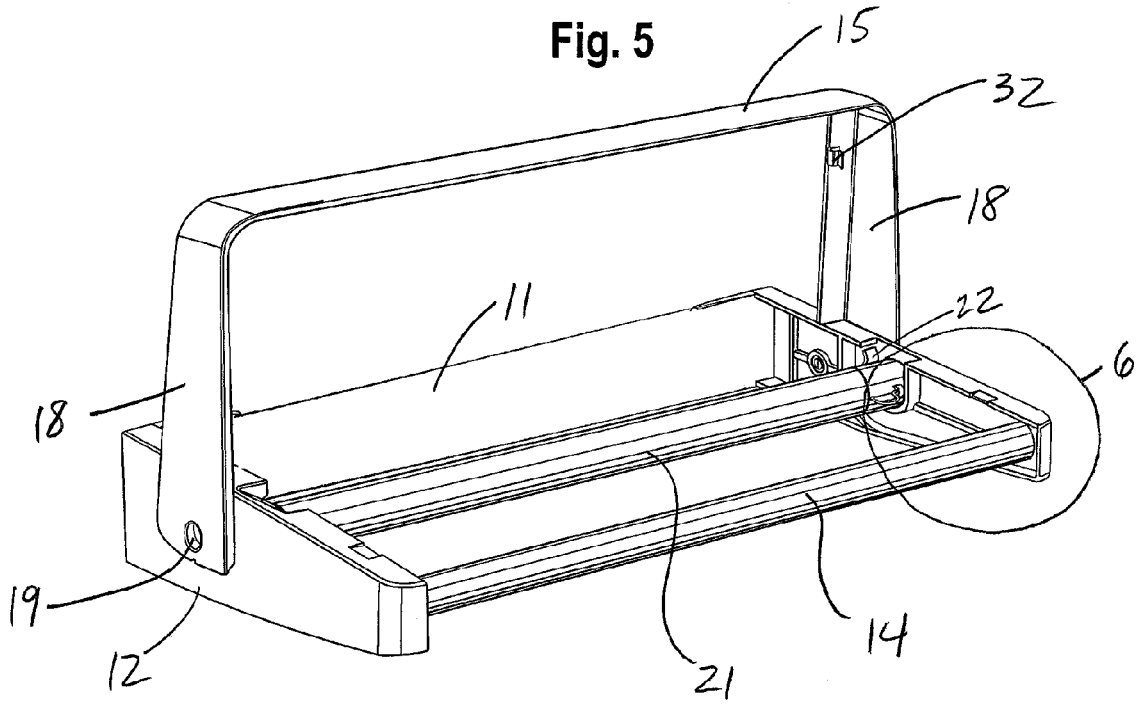
FIG. 5 is a view similar to FIG. 1, but shown with the roll of paper towels removed.
Figure 8:
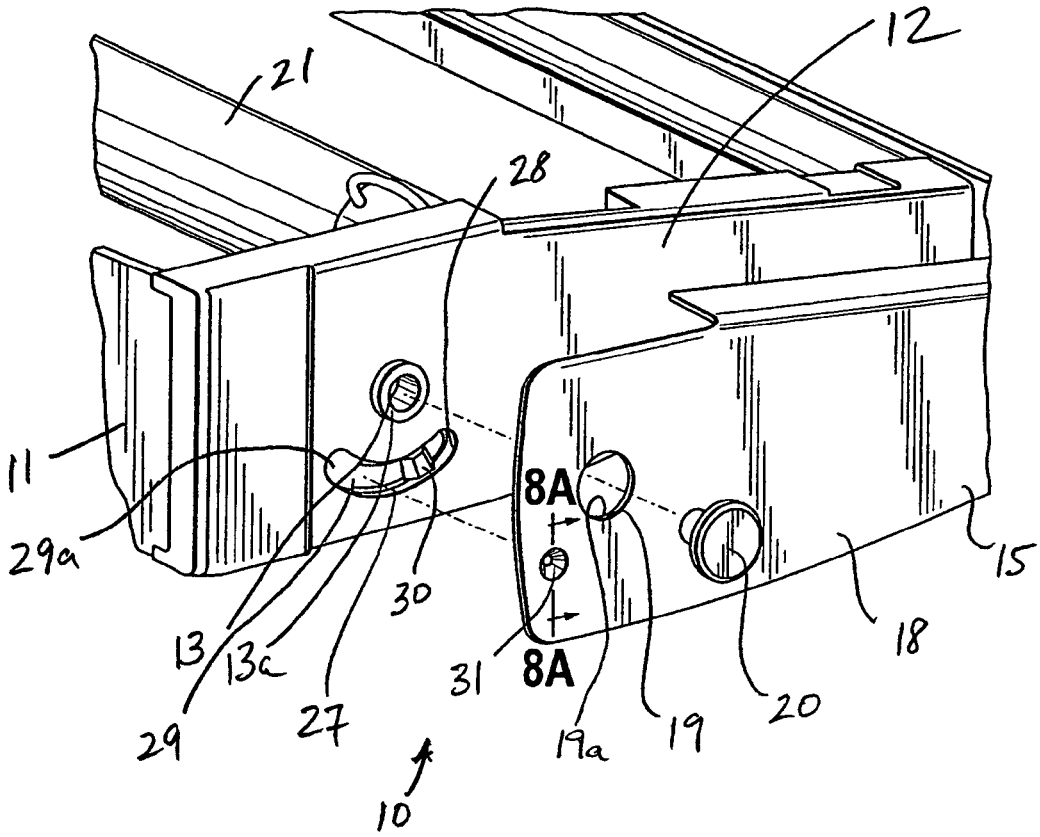
FIG. 8 is an enlarged, fragmentary view of the first and second pivoting structures.
Figure 8A:
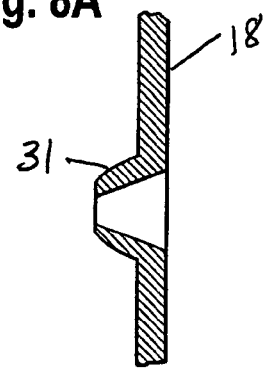
FIG. 8*a* is a cross-sectional view taken along line 8A-8A in FIG. 8.
Figure 9:
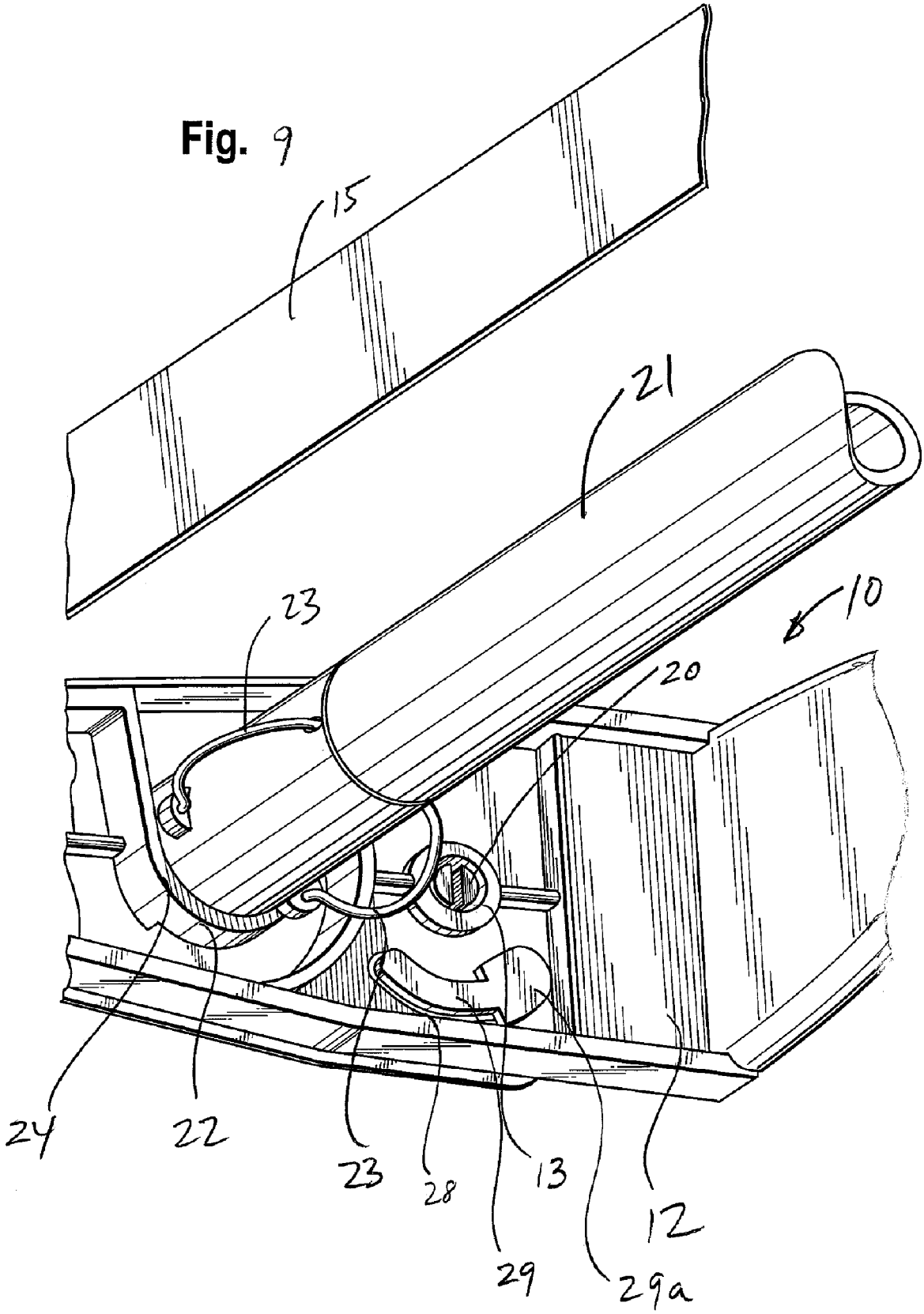
FIG. 9 is an enlarged, fragmentary perspective view of the roller retained in the retaining mechanism.
Figure 10:
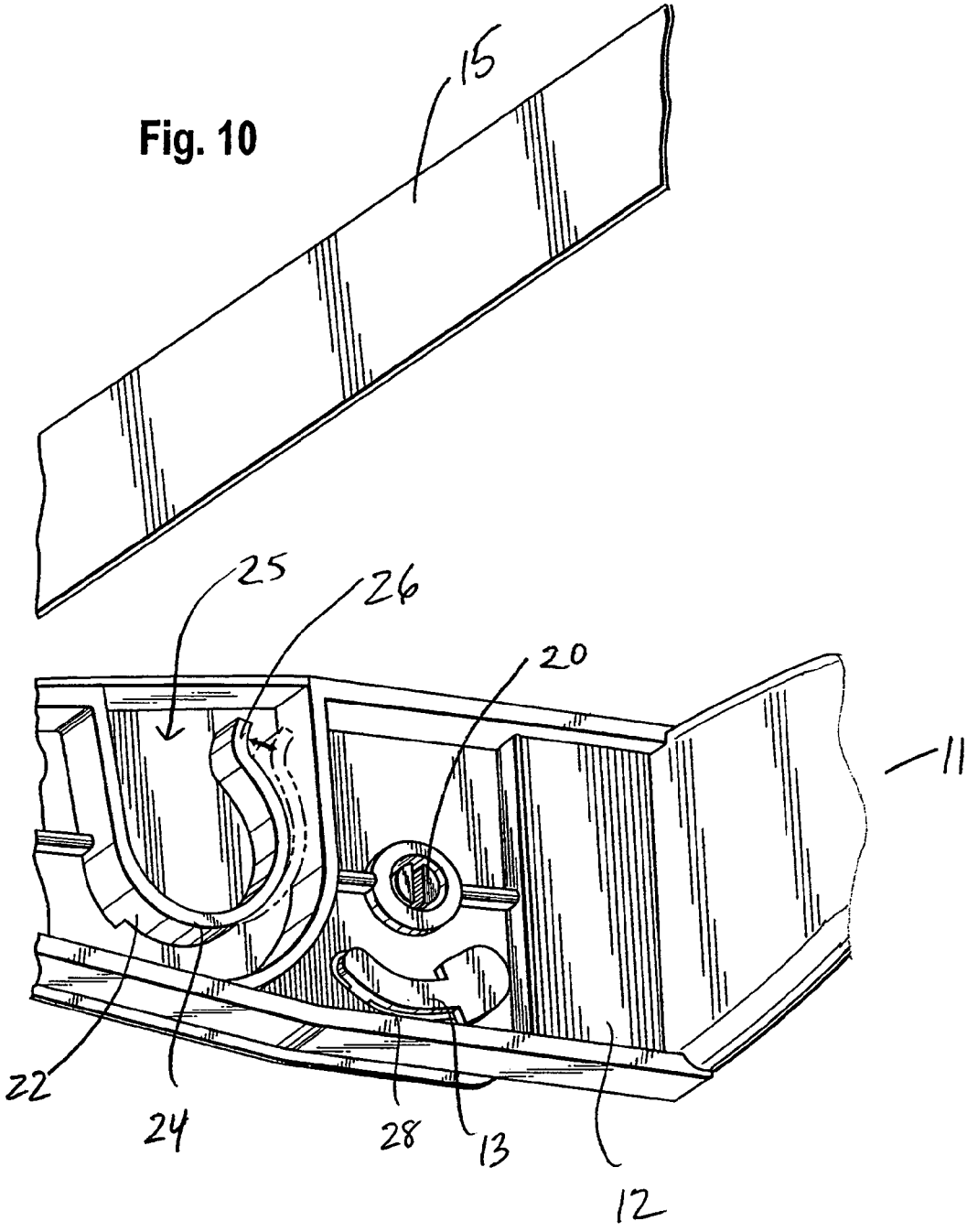
FIG. 10 is a view similar to FIG. 9, but with the roller removed from the retaining mechanism.

Paper towels typically are formed of a plurality of web sheets arranged in a roll. The roll typically has a cardboard tube with an inner wall and an inner diameter disposed substantially through the center of the paper towel roll, thereby defining an axis of rotation. The sheets of paper towels are generally separated by rows of perforations. The roll of paper towels also have a maximum outer diameter, which is typically defined by the number of sheets of paper towels, the thickness of the sheets and the like. Such a roll of paper towels is well-known.

The present application discloses a dispenser for dispensing one or more paper towel sheets from a web of paper towels. Referring to the figures, the dispenser 10 includes a base member 11 which is adapted to support a roll of sheets of paper towels for rotation about an axis A. The base member 11 may be adapted to be secured to a surface, such as, for example, a wall, a countertop, the underside of a cabinet, or the like, in a well-known manner. The base member 11 may include two arms 12 which extend outwardly therefrom. The arms 12 are respectively disposed at opposing ends of the base member 11. Each arm 12 has a first pivoting structure 13 disposed on respective outside surfaces of the arms 12.

The dispenser further includes a first guide bar 14 carried by the base member 11. The first guide bar 14 extends substantially parallel to the axis A, when a roll of paper towels is supported by the base member 11, and is spaced from the axis A a distance greater than the maximum radius of the roll of sheets. It will be appreciated that the roll can rotate about the axis A uninhibited by the first guide bar 14. The first guide bar 14 may be transversely coupled between the arms 12 adjacent to respective outer ends of the arms 12.

In an embodiment, the dispenser includes a second guide bar 15 which extends substantially parallel to the axis A and which is carried by the base member 11. The second guide bar 15 is adapted for movement, relative to the first guide bar 14, between a loading position, which facilitates load and unloading of the roll onto the base member, and a dispensing position, wherein the second guide bar is spaced from the first guide bar by a narrow gap 16 through which a leading end 17 of the roll may be freely received therein. The second guide bar 15 may include extensions 18 at respective ends thereof. The extensions 18 respectively have second pivoting structures 19 disposed thereon for respective pivotal engagement with the first pivoting structures 13 to accommodate pivotal movement of the second guide bar between the loading and the dispensing positions, relative to the first guide bar 14.

In an embodiment, first and second pivoting structures 13, 19 include substantially axially aligned apertures 13*a*, 19*a* respectively disposed on the extensions 18 and the arms 12. The apertures 13*a*, 19*a* are adapted to receive a pivot pin 20 therethrough.

In an embodiment, the dispenser 10 includes a substantially cylindrical roller 21 which is adapted to be disposed within the tube if the roll of paper towels and which is adapted to be transversally disposed between the arms 12. When disposed between the arms 12, the roller 21 is rotatably coupled thereto with retaining structures 22 disposed on respective inner surfaces of the arms 12 so that the first guide bar 14 is spaced from the outer diameter of the roll. In an embodiment, the retaining structures 22 are respectively disposed substantially intermediate the base member 11 and the first guide bar 14. It will be appreciated that the retaining structures 22 are adapted to allow manual removal and installation of the roller 21.

In an embodiment, the roller 21 includes a plurality of circumferentially spaced ribs 23 that extend radially outwardly adjacent to each end of the roller 21. The ribs 23 are adapted to frictionally abut the inner wall of the tube when the roller 21 is disposed in the tube. In an embodiment, the ribs 23 are pliable.

The retaining structure 22 may comprise a substantially U-shaped pliable member 24 defining an opening 25 with at least one outwardly flared end 26. The opening 25 has a normal dimension that is less than the outer diameter of the respective ends of the roller 21. The opening 25 is adapted to pliably allow the end of the roller 21 be inserted therethrough and it is adapted to substantially return to the normal dimension when the roller 21 is fully inserted in the U-shaped member 24, thus rotatably securing the roller 21. In an embodiment, when the roller 21 is fully inserted in the U-shaped member 24, the U-shaped member 24 provides slight frictional drag on the end of the roller 21 to provide control when the paper towel roll is rotated about its axis A.

In an embodiment, the dispenser 10 includes a first detent mechanism 27 adapted to detain the second guide bar 15 in the loading position. In an embodiment, the first detent mechanism 27 is disposed on one of the arms 12. In another embodiment, the first detent mechanism 27 is disposed adjacent to the first pivoting structure 13. In yet another embodiment, the dispenser 10 includes a plurality of first detent mechanisms 27.

In an embodiment, the first detent mechanism 27 includes a substantially arcuate aperture 28 with a substantially arcuate pliable member 29 disposed therein. The pliable member 29 is coupled to the arm 12 at one end 29*a* of the pliable member 29. The pliable member 29 may include a protuberance 30 adjacent to an end opposite the end 29*a* coupled to the wall 12. The first detent mechanism 27 may further include a rounded protrusion 31 disposed on an adjacent extension 18 for cooperative engagement with the pliable member 29, wherein the pliable member 29 is adapted to detain the substantially rounded protrusion 31 between the protuberance 30 and a wall of the aperture 28. Accordingly, when being moved from the loading position to the dispensing position, a force applied to the second guide bar 15 causes the first detent mechanism 27 to disengage, allowing travel of the second guide bar 15 to the dispensing position.

In an embodiment, the dispenser 10 includes a second detent mechanism 32 which is adapted to detain the second guide bar 15 in the dispensing position. The second detent mechanism 32 may be disposed on one of the extensions 18 and may include a latch member 33 pliably coupled to the extension 18. It will be appreciated that when the second guide bar 15 is disposed in the dispensing position, the extension 18 is adjacent to the arm 12, wherein the latch member 33 may cooperatively engage a lip 34 formed on the arm 12 to detain the second guide bar 15.

Also disclosed herein is a method of dispensing paper towel sheets from a web of sheets arranged in a roll having and separated by rows of perforations. The method includes providing a base member adapted to support a roll of sheets for rotation about an axis, providing a first guide bar fixedly carried by the base and extending parallel to the axis and spaced from the axis a distance greater than a maximum radius of the roll of sheets, providing a second guide bar extending substantially parallel to the axis and carried by the base for movement, relative to the first guide bar, between a loading position facilitating loading of the roll onto the base and a dispensing position spaced from the first guide bar by a narrow gap, disposing a leading end of the roll through the narrow gap, causing a generally pulling force to be applied to the leading end until a desired number of paper towel sheets have extended beyond the second guide bar, and causing a generally outwardly directed force to be applied by the paper towel sheets against the second guide bar, whereby causing the perforation adjacent to the second guide bar to tear.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicant's contribution. The actual scope of the protection sought is intended to be defined in the following claims when viewed in their proper perspective based on the prior art.

What is claimed is:

1. A device for dispensing paper towel sheets from a web of sheets arranged in a roll having a cylindrical tube with an inner wall disposed substantially centrally therein and separated by rows of perforations, the device comprising:

a base member adapted to support a roll of sheets for rotation about an axis;

a first guide bar fixedly carried by the base member and extending substantially parallel to the axis and spaced from the axis a first distance greater than a maximum radius of the roll of sheets; and a second guide bar extending substantially parallel to the axis and carried by the base member for movement relative to the first guide bar, between a loading position facilitating loading of the roll onto the base member and a dispensing position spaced from the first guide bar by a narrow gap through which a leading end of the roll may be freely received, the second guide bar spaced a second distance from the axis, the second distance being greater than the first distance when the second guide bar is in the dispensing position.

2. The device as claimed in claim 1 wherein the base member is adapted to be secured to a surface.

3. The device as claimed in claim 1 wherein the base member includes arms extending outwardly therefrom respectively disposed at opposite ends thereof, each arm having a first pivoting structure disposed on respective outside surfaces thereof.

4. The device as claimed in claim 3 wherein the first guide bar is transversely coupled between the arms adjacent to respective outer ends of the arms.

5. The device as claimed in claim 3 further comprising a substantially cylindrical roller adapted to be transversally disposed between the arms and being rotatably coupled thereto with a retaining structure disposed on respective inner surfaces of the arms substantially intermediate the base member and the first guide bar, the retaining structure adapted to allow manual removal and installation of the roller.

6. The device as claimed in claim 5 wherein the roller includes a plurality of circumferentially spaced ribs extending radially outwardly adjacent to each end thereof, the ribs adapted to frictionally abut the inner wall when the roller is disposed in the tube.

7. The device as claimed in claim 5 wherein the retaining structure includes a substantially U-shaped pliable member having an opening with an outwardly flared end, the opening having a normal dimension less than an outer diameter of the ends of the roller and being adapted to pliably receive the end of the roller when inserted therein and adapted to substantially return to the normal dimension when the roller is fully inserted in the U-shaped member to provide a frictional drag force to the roller when the roll of sheets is rotated about the axis.

8. The device as claimed in claim 3 wherein the second guide bar includes extensions at respective ends thereof, the extensions respectively having second pivoting structures disposed thereon for respective pivotal engagement with the first pivoting structures to accommodate pivotal movement of the second guide bar between the loading and the dispensing positions.

9. The device as claimed in claim 8 further comprising a first detent mechanism disposed adjacent to at least one of the first pivoting structures and being adapted to detain the second guide bar in the loading position.

10. The device as claimed in claim 9 wherein the first detent mechanism comprises a substantially arcuate aperture and a substantially arcuate pliable member disposed therein and coupled to an arm at one end thereof, the pliable member including a protuberance disposed adjacent to an end opposite the end coupled to a wall, the member being adapted to detain a substantially rounded protrusion disposed on one of the extensions between the protuberance and a wall of the aperture.

11. The device as claimed in claim 8 further comprising a second detent mechanism disposed on one of the extensions and being adapted to detain the second guide bar in the dispensing position.

12. The device as claimed in claim 11 wherein the second detent mechanism comprises a latch member pliably coupled to one of the extensions.

13. The device as claimed in claim 8 wherein the first and second pivoting structures comprise substantially axially aligned apertures respectively disposed on the extensions and the arms and being adapted to receive pivot pins therethrough.

14. A device for dispensing paper towel sheets from a web of sheets arranged in a roll having a cylindrical tube with an inner wall disposed substantially centrally therein and separated by rows of perforations, the device comprising:

a base member adapted to support a roll of sheets for rotation about an axis, the base member including arms extending outwardly therefrom respectively disposed at opposite ends thereof, the arms respectively having first pivoting structures disposed on respective outside surfaces thereof;

a first guide bar transversally carried by the arms and extending substantially parallel to the axis and spaced from the axis a first distance greater than a maximum radius of the roll of sheets; and a second guide bar having extensions at respective ends thereof, the extensions respectively having second pivoting structures disposed thereon for respective pivotal engagement with the first pivoting structures to accommodate pivotal movement of the second guide bar, relative to the first guide bar, between a loading position facilitating loading of the roll onto the base member and a dispensing position spaced from the first guide bar by a narrow gap through which a leading end of the roll may be freely received, the second guide bar spaced a second distance from the axis, the second distance being greater than the first distance when the second guide bar is in the dispensing position.

15. The device as claimed in claim 14 further comprising a substantially cylindrical roller adapted to be transversally disposed between the arms and being rotatably coupled thereto with a retaining structure disposed on respective inner surfaces of the arms substantially intermediate the base member and the first guide bar, the retaining structure adapted to allow manual removal and installation of the roller.

16. The device as claimed in claim 14 wherein the roller includes a plurality of circumferentially spaced ribs extending radially outwardly adjacent to each end thereof, the ribs adapted to frictionally abut the inner wall when the roller is disposed in the tube.

17. The device as claimed in claim 14 wherein the retaining structure includes a substantially U-shaped pliable member having an opening with an outwardly flared end, the opening having a normal dimension less than an outer diameter of the ends of the roller and being adapted to pliably receive the end of the roller when inserted therein and adapted to substantially return to the normal dimension when the roller is fully inserted in the U-shaped member to provide a frictional drag force to the roller when the roll of sheets is rotated about the axis.

18. The device as claimed in claim 14 further comprising a first detent mechanism disposed adjacent to at least one of the first pivoting structures and being adapted to detain the second guide bar in the loading position.

19. The device as claimed in claim 14 further comprising a second detent mechanism disposed on one of the extensions and being adapted to detain the second guide bar in the dispensing position.

20. A method of dispensing paper towel sheets from a web of sheets arranged in a roll having and separated by rows of perforations, the method comprising:

providing a base member adapted to support the roll of sheets for rotation about an axis;

providing a first guide bar fixedly carried by the base member and extending parallel to the axis and spaced from the axis a first distance greater than a maximum radius of the roll of sheets;

providing a second guide bar extending substantially parallel to the axis and carried by the base for movement, relative to the first guide bar, between a loading position facilitating loading of the roll onto the base member and a dispensing position spaced from the first guide bar by a narrow gap, the second guide bar spaced a second distance from the axis, the second distance being greater than the first distance when the second guide bar is in the dispensing position;

disposing a leading end of the roll through the narrow gap;

causing a generally pulling force to be applied to the leading end until a desired number of paper towel sheets have extended beyond the second guide bar; and causing a generally outwardly directed force to be applied by the paper towel sheets against the second guide bar, whereby causing the perforation adjacent to the second guide bar to tear.

* * * * *